US007404538B2

(12) United States Patent
Gill et al.

(10) Patent No.: US 7,404,538 B2
(45) Date of Patent: Jul. 29, 2008

(54) DUAL RESTRICTOR SHUT-OFF VALVE

(75) Inventors: Scott D. Gill, Fort Wayne, IN (US); Justin C. Miller, Fort Wayne, IN (US); Frederick J. Pilon, New Haven, IN (US)

(73) Assignee: Parker-Hannifin Corporation, Cleveland, OH (US)

( * ) Notice: Subject to any disclaimer, the term of this patent is extended or adjusted under 35 U.S.C. 154(b) by 396 days.

(21) Appl. No.: 10/992,974

(22) Filed: Nov. 19, 2004

(65) Prior Publication Data

US 2005/0178445 A1 Aug. 18, 2005

Related U.S. Application Data

(60) Provisional application No. 60/524,145, filed on Nov. 21, 2003.

(51) Int. Cl.
*F25B 41/06* (2006.01)

(52) U.S. Cl. ..... 251/118; 137/513.3; 62/511; 62/527

(58) Field of Classification Search ..... 137/493.8, 137/493.9, 513.3; 62/125, 129, 222, 292, 62/324.6, 511, 527; 251/118; 138/44, 45, 138/46

See application file for complete search history.

(56) References Cited

U.S. PATENT DOCUMENTS

| | | | | |
|---|---|---|---|---|
| 2,393,854 A | | 1/1946 | Carpenter | |
| 4,644,973 A | * | 2/1987 | Itoh et al. | 62/292 |
| 5,186,021 A | * | 2/1993 | Keller | 62/511 |
| 5,265,438 A | | 11/1993 | Knowles et al. | |
| 5,507,468 A | | 4/1996 | Evans | |
| 5,893,273 A | | 4/1999 | Casiraghi | |
| 6,182,457 B1 | | 2/2001 | Enderle | |
| 6,367,283 B1 | * | 4/2002 | Enderle | 62/511 |
| 6,378,328 B1 | | 4/2002 | Cholkeri et al. | |
| 6,442,966 B1 | | 9/2002 | Wiser | |
| 6,560,987 B2 | | 5/2003 | Kreger et al. | |

FOREIGN PATENT DOCUMENTS

| | | |
|---|---|---|
| EP | 0 898 132 A2 | 2/1999 |
| EP | 0 921 210 B1 | 11/2002 |

OTHER PUBLICATIONS

U.S. Appl. No. 60/524,145, Scott D. Gill et al., Dual Restrictor Shut-Off Valve, filed Nov. 21, 2003.

* cited by examiner

*Primary Examiner*—John Rivell
(74) *Attorney, Agent, or Firm*—Joseph J. Pophal; Daniel J. Whitman; Robert J. Clark

(57) ABSTRACT

A shut-off valve for pressurized fluids in an air cooling/heating apparatus having a first duct receiving a first restrictor and a second restrictor. Both restrictors are coaxially formed with a capillary through which the pressurized fluid passes and which causes the rapid expansion of the fluid when the fluid exits from a distal end of the capillary. The outer surface of the restrictors is in direct contact with the interior surface of the first duct. The valve can further include a sampling instrument located between the restrictors.

10 Claims, 5 Drawing Sheets

DUAL RESTRICTOR SHUT-OFF VALVE

RELATED CASES

The present application claims priority to U.S. Patent Application Ser. No. 60/524,145, filed Nov. 21, 2003, the disclosure of which is expressly incorporated herein by reference.

FIELD OF THE INVENTION

The present invention relates to a shut-off valve for pressurized fluids in an air cooling/heating system such as air conditioners and the like.

BACKGROUND OF THE INVENTION

It is known in the art of air conditioners and heat pumps that a condenser and an evaporator must be placed in communication with each other by means of shut-off valves and other devices designed to cause expansion of the refrigerant as the refrigerant flows from one component to another.

Specifically, in refrigerant systems operating in both the cooling and heating modes, two expansion devices may be incorporated into one system allowing for expansion of the fluid in either direction. A shut-off valve may also be incorporated into a system when there is a need to terminate refrigerant flow, such as for example, during servicing. The refrigerant system may also include a sampling port for detecting and measuring the pressure of the high-pressure refrigerant before the refrigerant enters the expansion device. Furthermore, the ability to easily interchange the expansion devices allows the degree of expansion to be selectively varied after installation of the shut-off valve.

Combining the shut-off valve, expansion devices and sampling device into one unit is desirable to reduce the complexity of a refrigerant system. However, known refrigerant systems lack a mechanism for sampling the liquid refrigerant before the liquid enters the expansion devices in both the cooling and heating modes. Therefore, a need exists for a shut-off valve that allows for sampling high-pressure liquid between two expansion devices.

Prior art dual restrictors utilize a labor intensive process of manually torch brazing the connecting tube to the shut-off valve body in order to protect expansion devices integrated within the body. It is desired to use a more cost efficient process of furnace brazing the tube onto the valve body. Therefore, a need exists for a shut-off valve having integrated expansion devices which will not be adversely affected by the furnace brazing process.

SUMMARY OF THE INVENTION

The present invention resolves the above noted problem by providing a shut-off valve for pressurized fluid in an air cooling/heating apparatus having a first duct that receives a first restrictor and a second restrictor. Both of the restrictors are coaxially formed with a capillary through which the pressurized fluid passes and which causes rapid expansion of the fluid when the fluid exits from a distal end of the capillary. The outer surface of the restrictors is in direct contact with the interior surface of the first duct.

A feature of the above noted valve has the valve including a sampling instrument, located between the restrictors, for sampling fluid. Another feature of the above noted valve has both of the restrictors being capable of independent axial movement within the first duct. A further feature of the noted valve has an outer portion of each restrictor being formed with at least two radial fins that cooperate with interior surfaces of the first duct to create at least one flow channel for fluid flow.

Still another feature of the noted valve has the first restrictor being fixed within the first duct and having a longitudinal end with a conical surface in sealing contact with a flared connecting pipe. The second restrictor having an outer portion formed with at least two radial fins cooperating with the interior surface of the first duct to create at least one flow channel for fluid flow. The second restrictor being axially movable from a first position in which a sealing member of the second restrictor is in sealing contact with a shoulder formed within the first duct to a second position in which the second restrictor is in contact with the first restrictor. A further feature of this noted valve has, when the second restrictor is in the second position, fluid flow being directed entirely through the capillary.

Yet another feature of the noted valve has the restrictors being removable from the duct and the valve. Still another feature of the noted valve has the restrictors being replaceable.

Still yet another feature of the present invention has the shut-off valve being in communication with at least one condenser and at least one fluid evaporator and having the first duct being in communication with the evaporator. The valve will further include a second duct in communication with the condenser and a third duct. The first duct receives a first restrictor and a second restrictor which are both coaxially formed with a capillary through which fluid passes and which cause rapid expansion of the fluid when the fluid exits from a distal end of the capillary. The outer surface of the restrictors is in direct contact with the interior surface of the first duct.

Another attribute of the noted valve has at least the second restrictor being capable of independent axial movement within the first duct. Still another attribute of the noted valve has the first restrictor clamping an end of a pipe directly against a surface of the first restrictor. Yet another attribute has the first restrictor selectively secured to the first duct by threaded engagement. Still another feature has the third duct receiving an instrument for sampling fluid in the valve. Another feature has the third duct located intermediate the first and second ducts, such that the fluid sampling instrument can sample fluid prior to the fluid passing through a restrictor when the air cooling/heating apparatus is in one mode of operation.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION OF PREFERRED EMBODIMENTS

Figure 1:
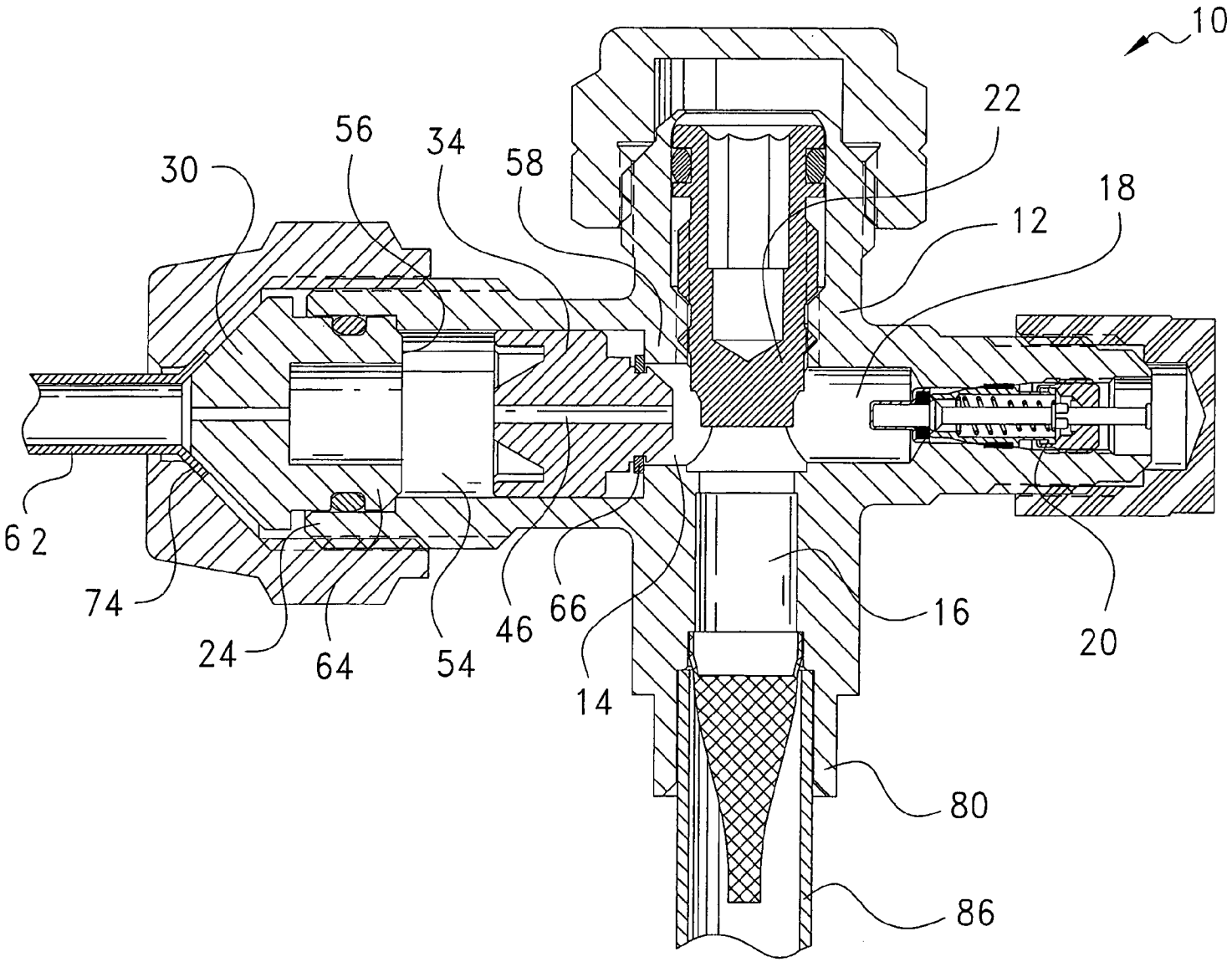
FIG. 1 is a sectioned view of a shut-off valve according to the present invention.
Figure 3:
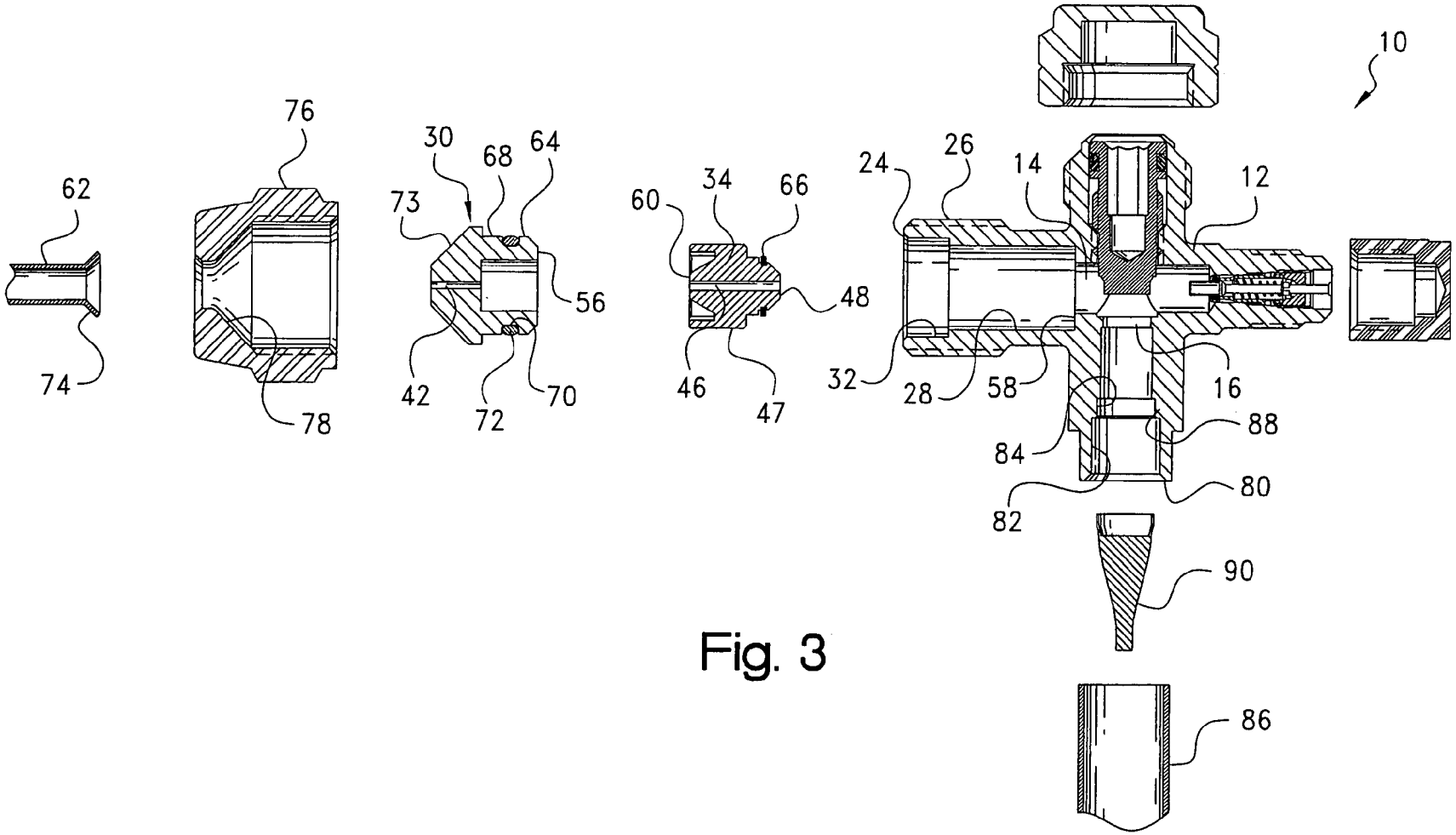
FIG. 3 is a sectioned exploded view of the shut-off valve shown in FIG. 1.

Referring to FIGS. 1 and 3, an embodiment of a shut-off valve 10 in accordance with the principles of the current invention is shown. Shut-off valve 10 includes a body 12 that has at least two ducts formed there through. A first duct 14 communicates with an evaporator (not illustrated). A second duct 16 communicates with a condenser (not illustrated). Preferably, valve body 12 includes a third duct 18 that is adapted to receive a sampling mechanism 20 for allowing the detection and measurement of the fluid pressure between ducts 14, 16 and 18, to be explained in further detail below. As will be discussed below, shut-off valve 10 allows an enduser to replace (or switch out) restrictors that typically are permanently installed within the shut-off valve. The present invention also provides a poke-yoke methodology, as shown in U.S. Pat. No. 6,546,952 to Martin et al., assigned to the assignee of the present invention and herein incorporated by reference. This ensures the proper installation of the restrictors when replacing the restrictor in the field, as well as in production assembly. Further, shut-off valve 10 has a reduced manufacturing cost with fewer components than in the prior art.

Valve 10 further includes an obturator 22 that may be displaced by rotation between a closed position in which fluid flow between first duct 14 and second duct 16 is blocked (not shown) and an open position in which flow between first duct 14 and second duct 16 is permitted (shown as open in FIG. 1). As seen in FIG. 3, first duct 14, that is in communication with the evaporator, is formed inside a first outlet 24 of body 12 with an external thread 26 located on body 12. Outlet 24 has positioned therein two coaxial seats 28 and 32. Coaxial seats 28 and 32 receive and house a restrictor 34 and a flared restrictor 30 respectively. The inside diameter of each coaxial seat 28 and 32 is slightly larger than the outside diameter of restrictors 34, 30 respectively, such that restrictor 34 and flared restrictor 30 are slidably assembled in their respective seats without interference. The outer surface of restrictors 30, 34 are in direct contact with seats 32, 28 respectively, thus minimizing the number of components of valve 10. Stated another way, the outer surface of restrictors 30, 34 are in direct contact with the defining surface of duct 14.

Restrictor 34 is formed with an axial capillary duct 46 with a predetermined diameter that corresponds to the desired degree of expansion of the fluid. Restrictor 34 is provided with a plurality of radial fins 47 that cooperate with seat 28 to create a plurality of flow channels for the free flow of fluid. A void 54, (best seen in FIG. 1) defined between an axial surface 56 of flared restrictor 30 and a shoulder 58 of seat 28, allows for a limited degree of axial movement of restrictor 34. A frontal projection 48 is designed to cooperate with shoulder 58 of seat 28 in order to limit axial movement of restrictor 34 in a direction towards obturator 22. Specifically, frontal projection 48 has a radial sealing member 66 that sealingly contacts shoulder 58. Similarly, axial surface 56 of flared restrictor 30 is designed to cooperate with a rear axial surface 60 of restrictor 34 to limit axial movement of restrictor 34 in a direction toward a connecting pipe 62.

Flared restrictor 30 has an end portion 64 received within outlet 24. A cylindrical portion 68 of restrictor 30 engages seat 32 in outlet 24 so as to provide a seal to prevent the passage of fluid. Preferably, cylindrical portion 68 of flared restrictor 30 is also formed with an annular seat 70 housing an annular sealing element 72 such as an O-ring. Flared restrictor 30 further includes a conical surface 73 designed to cooperate with a flared end 74 of connecting pipe 62 to ensure a seal. Flared restrictor 30 can only be received, or housed, within duct 14 with its conical surface 73 towards connecting pipe 62. This ensures a correct orientation and assembly of restrictor 30. Restrictor 30 is preferably retained in seat 32 by a nut 76 that can be tightened on external thread 26 of outlet 24. An internal conical surface 78 of nut 76 acts against flared end 74 of connecting pipe 62 forming a seal between connecting pipe 62 and flared restrictor 30. Restrictor 30 is formed with an axial capillary duct 42 with a predetermined diameter that corresponds to the desired degree of expansion of the fluid.

Second duct 16, in communication with the condenser (not shown), is formed inside a second outlet 80 of body 12. Outlet 80 has formed therein an internal conical seat 84 that receives and houses a filtering element 90. Filtering element 90 is retained in seat 84 by a second connecting pipe 86 that abuts a shoulder 88 created between seat 84 and a seat 82. Connecting pipe 86 is retained in seat 82 and is fixedly attached to valve body 12 preferably by brazing connecting pipe 86 to outlet 80. However other suitable methods of attaching connecting pipe 86 and outlet 80 may also be employed.

Referring to FIGS. 1 and 3, during operation in the heating mode, fluid flows through valve 10 from connecting pipe 62 to connecting pipe 86, first passing through restrictor 30. The pressure of the fluid itself produces axial movement of restrictor 34 away from pipe 62 thus causing seal 66 to sealingly abut shoulder 58. In this configuration, the fluid from pipe 62 must flow only through capillary duct 46, and not around restrictor 34. When obturator 22 is in the open position, fluid may freely flow from first duct 14 into second duct 16. The fluid, in order for it to pass through restrictor 34, is channeled into capillary duct 46 causing expansion of the fluid as it exits capillary duct 46. The expanded fluid then exits valve 10 through a filtering element 90 and proceeds into pipe 86, which is affixed to body 12 at outlet 80. It should be noted that since the fluid is passing through two capillary ducts 42, 46, it is advantageous to have the diameter of capillary duct 46 be smaller than that of duct 42 so that restriction properly occurs. Of course, an enduser can freely replace (or switch) restrictors 30, 34 with restrictors having any orifice size.

Figure 4:
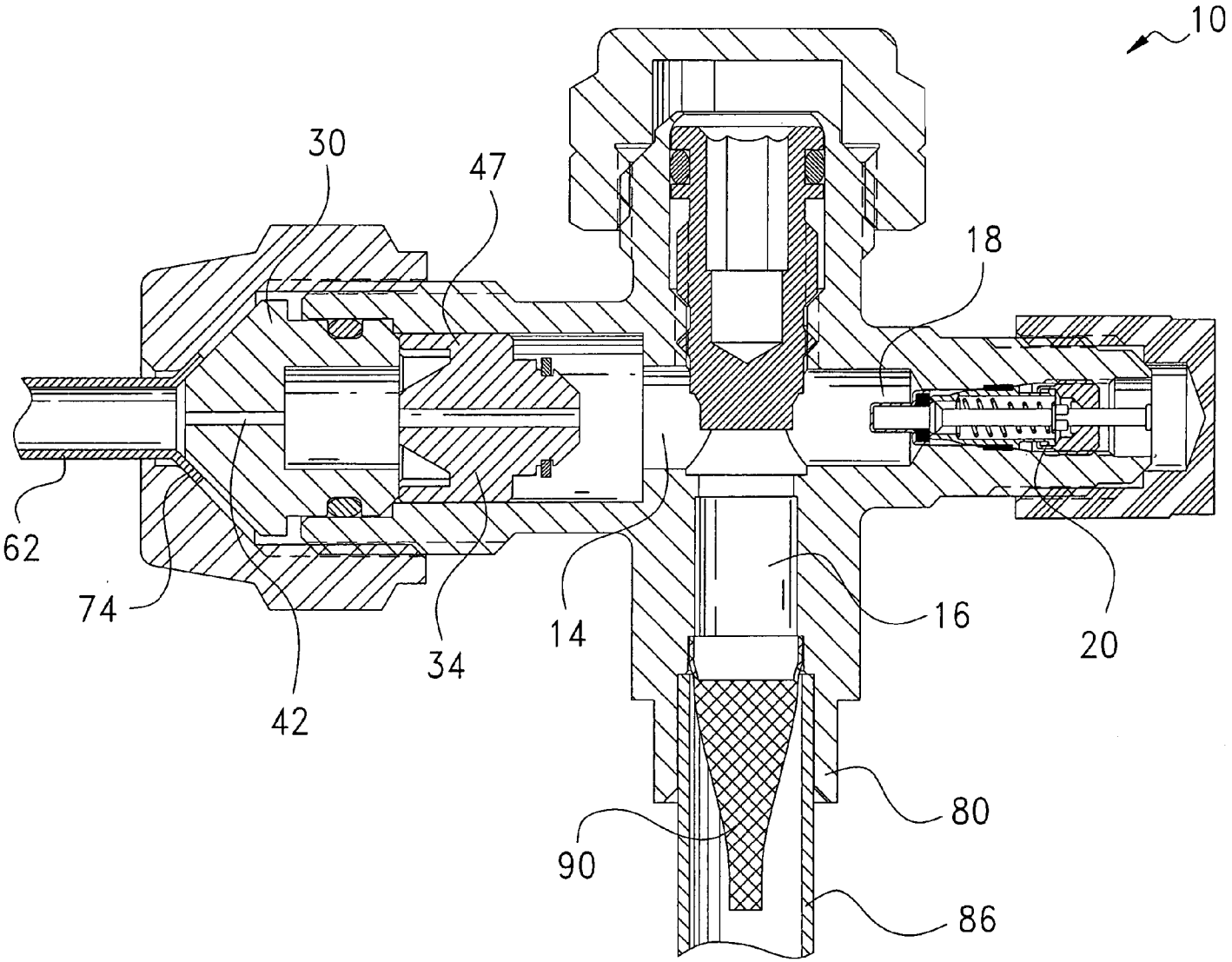
FIG. 4 is a partially sectioned view of the shut-off valve operating in the cooling mode.

Operation occurs in a substantially similar manner, but in the opposite direction, during operation of the valve in the cooling mode as illustrated in FIG. 4. During operation in the cooling mode, fluid enters outlet 80 through pipe 86 and flows through filtering element 90. When obturator 22 is in the open position (as is shown in FIG. 4), fluid travels from duct 16 into duct 14 such that fluid pressure produces movement in restrictor 34 towards connecting pipe 62 to open fluid flow around restrictor 34, or through radial fins 47. In this configuration, the fluid is able to flow freely until it encounters restrictor 30 where it is channeled through capillary 42 causing expansion of the fluid as the fluid exits capillary duct 42 through connecting pipe 62.

In operation, fluid flows through valve 10 from pipe 62 to pipe 86 in the heating mode and from pipe 86 to pipe 62 in the cooling mode. In the heating mode, fluid flows through restrictor axial capillary duct 46 into duct 14. When the obturator 22 is in the open position, the fluid is then free to flow into duct 16 and duct 18. As discussed above, with valve 10, in the heating mode the flow is directed towards the smaller orifice within restrictor 34. In contrast to this, for typical cooling modes the line set connection, or pipe 62, to the metering device, or restrictor 30 needs to be longer in length, therefore a larger diameter orifice is needed. This will provide greater pressure to compensate for the pressure loss in the cooling mode because of the length of metering to the evaporator coil is greater than of the heat pump mode. During the cooling mode, when obturator 22 is in the open position, fluid is free to flow from duct 16 into duct 18 so that the fluid pressure may be detected and measured via sampling mechanism 20. It should be noted that in addition to sampling, duct 18 is used as a charge port in both the heating and cooling modes.

Figure 2:
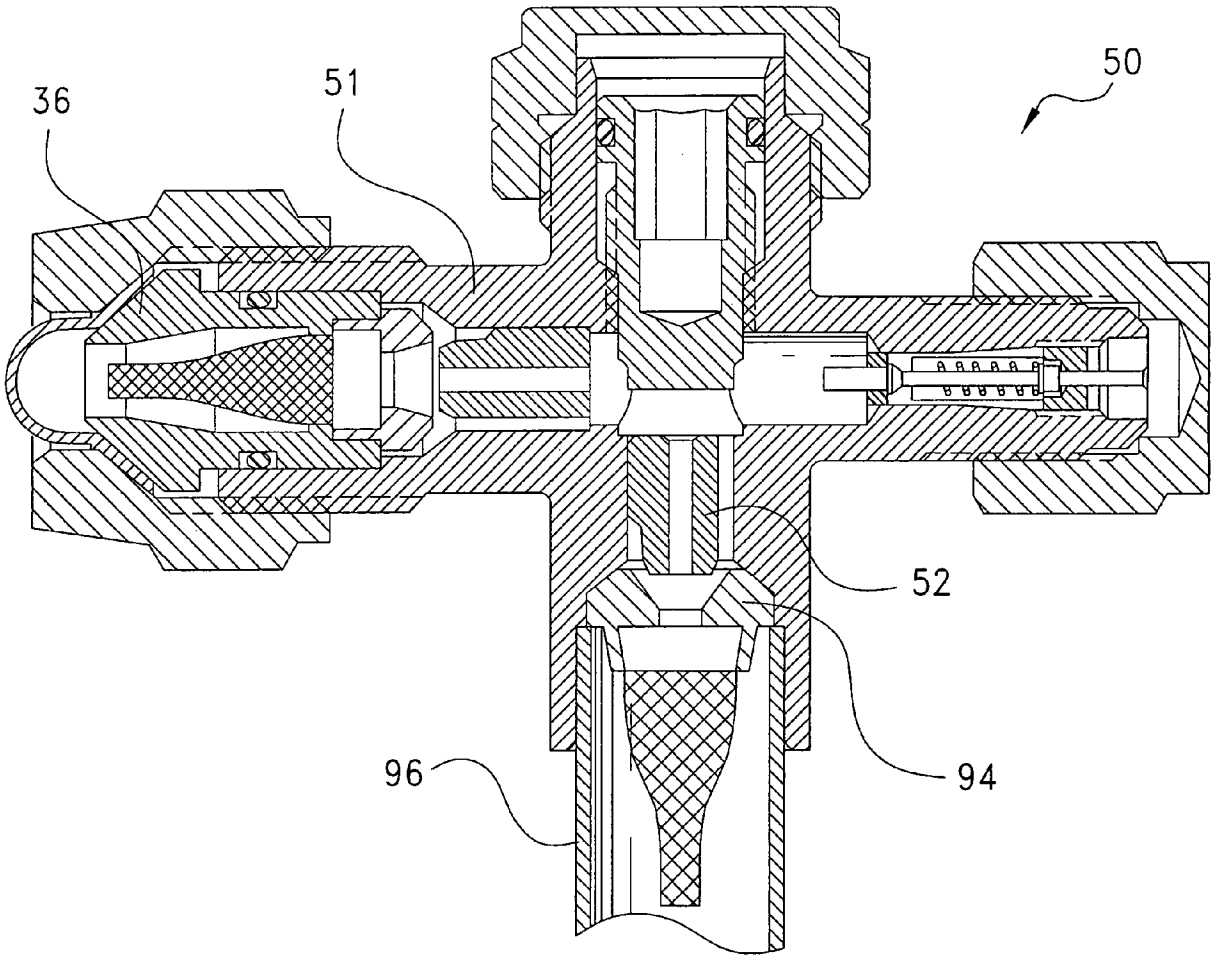
Fig. 2 (PRIOR ART)
FIG. 2 is a sectioned view of a prior art shut-off valve.

Referring to FIGS. 1 and 2, the present design reduces manufacturing cost by eliminating the need to press seat a prior art fitting 94 (as shown in FIG. 2), as well as significantly reducing the amount of components. Present invention restrictor 30 has been incorporate/combined with a flared adapter 36 (shown in FIG. 2). This reduces the number of parts when compared with a prior art shut-off valve 50. It should be noted that in addition to its metering (restriction) utility, restrictor 30 is now also used as the line set connection (which receives connecting pipe 62). Prior art shut-off valve 50 has a restrictor 52 encapsulated within a valve body 51 prior to a copper tube 96 being inserted into and permanently affixed with body 51. Copper tube 96 must then be manually torched brazed for connection to the system unit, which is an expensive process. A commonly used furnace brazing process is desired but can not be utilized in this prior art embodiment since the furnace brazing process exhibits too much heat which can cause restrictor 52 to fuse to valve body 51. Therefore the manually torch brazing technique needs to be used. By moving this restrictor to the field side (as is shown as restrictor 30 in FIG. 1), the more cost efficient furnace brazing technique can be used to attach pipe 86 in the present invention.

A flared connection 74 is advantageous because the connection can be easily disassembled allowing the substitution of restrictors. The ability to interchange a restrictor allows the shutoff valve to be field serviced without the need for complex brazing operations. Furthermore, restrictors with different capillary diameters may be employed such that the degree of expansion may be selectively varied. An end-user can replace or switch-out restrictors (30, 34) from the field connection end (located at connecting pipe 62). In the prior art (as shown in FIG. 2), since copper tube 96 is permanently brazed in place, restrictor 52 can not be replaced or switched. It is common for an end-user to change restrictors either for service reasons or to ensure that the proper sized orifice is used during its application. For example, if an application requires capillary duct 42 of restrictor 30 to be larger than capillary duct 46 of restrictor 34, the present invention allows an end-user to be able to use the proper restrictors for this application without replacing the entire shut-off valve. The present invention gives the end-user this flexibility so that flow during the heating and cooling cycles is most efficient.

Figure 5:
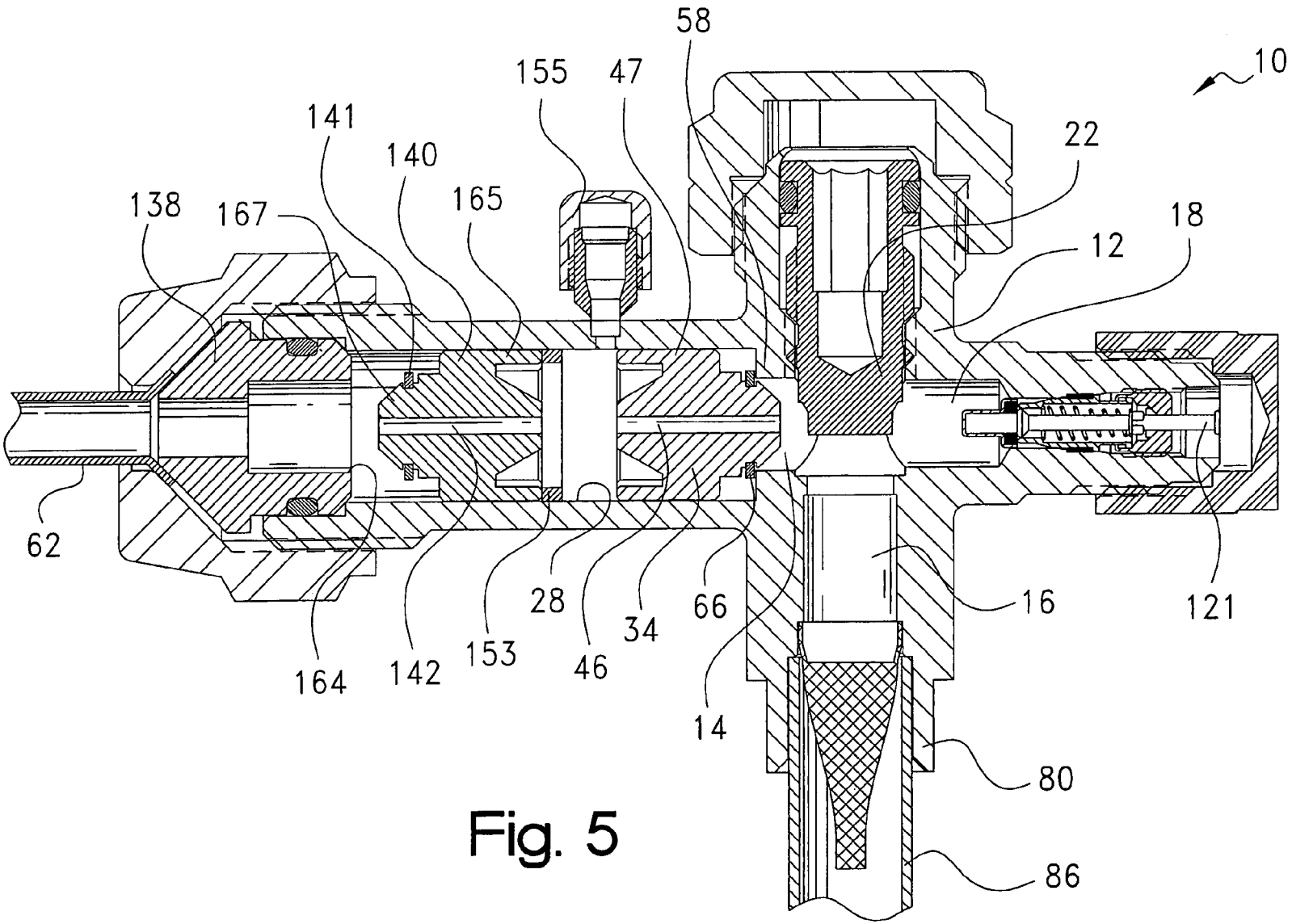
FIG. 5 is a partially sectioned view of a further embodiment shut-off valve according to the present invention.

FIG. 5 shows a further embodiment shut-off valve 110 according to the present invention. The majority of the components shown in FIG. 5 are similar to that shown in FIG. 1 and will use the same element numbers. Similar to shut-off valve 10 (detailed above), valve 110 has a body 12 with at least two ducts formed therein. Again, a first duct 14 communicates with an evaporator (not illustrated) and a second duct 16 communicates with a condenser (not illustrated). Valve 110 has removed restrictor 40, shown in FIG. 1, and replaced it with a restrictor 140 which can move axially (similar to restrictor 34). Also similar to restrictor 34, restrictor 140 has an axial capillary duct 142 with a predetermined diameter that corresponds to the desired degree of expansion of the fluid. Restrictor 140 is provided with a plurality of radial fins 165 that cooperate with seat 28 to create a plurality of flow channels for the free flow of fluid. Restrictor 140 can axially move between insert member and a spacer 153. A frontal projection 167 is designed to cooperate with a shoulder 164 of an insert member 138 in order to limit axial movement of restrictor 140. Specifically, frontal projection 167 has a radial sealing member 141 that sealingly contacts shoulder 164.

Valve 110 has also provided a sampling instrument 155 that can measure the pressure within duct 14 in both the heating and cooling modes. With valve 10 (shown in FIG. 1), the pressure measurement, as well as the charging operation, was conducted within duct 18 by sampling mechanism 20. The sampling function with valve 110 has been moved to duct 14. However, the charging operation still takes place within duct 18 with a charging valve 121. By integrating the sampling function within duct 14, pressure can now be measured in both the heating and cooling modes. As is well known in the art, unrestricted fluid can be sampled. Therefore there must be a free flow of fluid at the sampling location.

During the heating mode operation, fluid enters shut-off valve 110 from tube 62 attached to insert member 138. The fluid will pass through insert member 138 and move restrictor 140 to the right until it contacts spacer 153. Due to the axial passages through radial fins 165, fluid is not impeded when passing restrictor 140. The free flow of fluid can be sampled by sampling instrument 155 before reaching restrictor 34. The free flow of fluid moves restrictor 34 to the right and into sealing contact with shoulder 58, causing all fluid to pass through axial capillary duct 46. As discussed above, this causes the desired restriction of the fluid in the heating mode. During the cooling mode operation, fluid enters shut-off valve 110 through connecting pipe 86 and into ducts 16 and 14. Fluid causes restrictor 34 to move to the left and into contact with spacer 153. In this position and due to the axial passages through radial fins 47, fluid is not impeded by restrictor 34. The free flow of fluid can be sampled by sampling instrument 155 before reaching restrictor 140. The fluid then causes restrictor 140 to move to the left and into contact with insert member shoulder 164. In this position, fluid can only pass through axial capillary duct 142 and is properly restricted. As discussed with valve 10, proper sampling can take place during the heating and cooling modes when obturator 22 is in the open position.

This embodiment provides less restriction of the fluid in the heating mode and allows for sampling. As described above and shown with valve 10 in FIG. 1, restrictor 30 does not axially move. With shut-off valve 10, fluid passes through axial capillary duct 42 both in the heating and cooling operations even though restriction is only needed with capillary duct 46 in the heating mode. With valve 110, fluid is only restricted by one capillary duct (or restrictor orifice) 142, 46 in both the heating and cooling operation since both restrictors now axially oscillate. This embodiment still provides the option of switching (or replacing) restrictors 140, 34 since first duct 14 is accessible through the field connection end of shut-off valve 110. Again, valve 110 has simplified the number of components so that replacement of restrictors is an easy task and enables an enduser to sample the fluid in both the heating and cooling modes.

Preferred embodiments of the present invention have been disclosed. A person of ordinary skill in the art would realize, however, that certain modifications would come within the teachings of this invention. Therefore, the following claims should be studied to determine the true scope and content of the invention.

What is claimed is:

1. A valve, for pressurized fluid in an air cooling/heating apparatus having at least one duct, comprising:

a first duct receiving a first restrictor and a second restrictor, wherein both of said restrictors formed with a capillary through which said pressurized fluid passes and which causes rapid expansion of said fluid when said fluid exits from a distal end of said capillary;

wherein the outer surface of said restrictors is in direct contact with the interior surface of said first duct; and said first restrictor is fixed within said first duct and said second restrictor is axially movable within said first duct said first restrictor has a longitudinal end with a conical surface in sealing contact with a flared connecting pipe; and said second restrictor has an outer portion formed with at least two radial fins, said fins cooperating with the interior surface of said first duct to create at least one flow channel for fluid flow, said second restrictor axially movable from a first position in which a sealing member of said second restrictor is in sealing contact with a shoulder formed within said first duct to a second position in which said second restrictor is in contact with said first restrictor.

2. The valve according to claim 1 wherein in said first position, fluid flow is directed entirely through said capillary of said second restrictor.

3. The valve according to claim 1 wherein said restrictors are removable from said first duct.

4. The valve according to claim 1 wherein said restrictors are replaceable.

5. The valve according to claim 1 wherein said second restrictor can only be housed within said first duct in one orientation.

6. A valve for pressurized fluid in communication with at least one condenser and at least one fluid evaporator in an air cooling/heating apparatus, said valve comprising:

at least three ducts, a first duct in communication with the evaporator, a second duct in communication with the condenser, and a third duct;

wherein said first duct further receives a first restrictor, a second restrictor, wherein said restrictors are coaxially formed with a capillary through which fluid passes and which causes rapid expansion of the fluid when the fluid exits from a distal end of said capillary;

wherein the outer surface of said restrictors is in direct contact with the interior surface of said first duct; and said first restrictor is fixed within said first duct and said second restrictor is axially movable within said first duct;

wherein said first restrictor clamps an end of a pipe directly against a surface of said first restrictor.

7. The valve according to claim 6, wherein at least said second restrictor is capable of independent axial movement within said first duct.

8. The valve according to claim 7, wherein an outer portion of said second restrictor is formed with at least two radial fins, said fins cooperating with interior surfaces of said duct to create at least one flow channel for fluid flow.

9. The valve according to claim 6 wherein said first restrictor is selectively secured to said first duct by threaded engagement.

10. A shut-off valve for pressurized fluid in communication with at least one condenser and at least one fluid evaporator in an air cooling/heating apparatus, said valve comprising:

a valve body formed with at least three ducts, a first duct in communication with an evaporator, a second duct in communication with a condenser, and a third duct for receiving an instrument for sampling fluid in said valve;

an obturator in said body displaceable by rotation between a closed position in which fluid flow between said first duct and said second duct is blocked and an open position in which fluid flow between said first duct and said second duct is permitted;

wherein said first duct further receiving a first restrictor and a second restrictor, both coaxially formed with a capillary through which fluid passes and which causes rapid expansion of the fluid when the fluid exits from a distal end of said capillary;

wherein an outer portion of said second restrictor is formed with at least two radial fins, said fins cooperating with the interior surface of said first duct to create at least one flow channel for fluid flow;

wherein an outer portion of said first restrictor is in direct contact with the interior surface of said first duct;

wherein said second restrictor has an interior angled sealing surface that cooperates with a sealing end of said first duct to channel fluid flow through said capillary;

wherein said first restrictor has a conical end that clamps a flared end of a pipe; and wherein said valve further includes a connecting pipe fixedly received in a counterbore of said second duct.

* * * * *